US009418542B2

(12) United States Patent
Beckmann

(10) Patent No.: US 9,418,542 B2
(45) Date of Patent: Aug. 16, 2016

(54) METHOD FOR OPERATING A REMOTE CONTROL SYSTEM AND REMOTE CONTROL SYSTEM OF THIS TYPE

(71) Applicant: TEREX CRANES GERMANY GMBH, Zweibrücken (DE)

(72) Inventor: Axel Beckmann, Saarbrücken (DE)

(73) Assignee: TEREX CRANES GERMANY GMBH, Zweibrücken (DE)

( * ) Notice: Subject to any disclaimer, the term of this patent is extended or adjusted under 35 U.S.C. 154(b) by 0 days.

(21) Appl. No.: 14/428,739

(22) PCT Filed: Sep. 11, 2013

(86) PCT No.: PCT/EP2013/068817
§ 371 (c)(1),
(2) Date: Mar. 17, 2015

(87) PCT Pub. No.: WO2014/041022
PCT Pub. Date: Mar. 20, 2014

(65) Prior Publication Data

US 2015/0228185 A1 Aug. 13, 2015

(30) Foreign Application Priority Data

Sep. 17, 2012 (DE) ..... 10 2012 216 489

(51) Int. Cl.
*G08C 17/02* (2006.01)

(52) U.S. Cl.
CPC ..... *G08C 17/02* (2013.01); *G08C 2201/20* (2013.01); *G08C 2201/30* (2013.01); *G08C 2201/70* (2013.01)

(58) Field of Classification Search
CPC .. G06F 3/0488; G08C 17/02; G08C 2201/20; G08C 2201/30; G08C 2201/70
See application file for complete search history.

(56) References Cited

U.S. PATENT DOCUMENTS

| | | | | |
|---|---|---|---|---|
| 6,502,000 | B1 | 12/2002 | Arnold et al. | |
| 6,791,467 | B1 | 9/2004 | Ben-Ze'ev | |
| 8,823,485 | B2 | 9/2014 | Schmidt | |
| 2008/0180228 | A1 | 7/2008 | Wakefield et al. | |
| 2012/0136507 | A1* | 5/2012 | Everett | G05D 1/0011 701/2 |
| 2012/0146918 | A1 | 6/2012 | Kreiner et al. | |
| 2014/0268391 | A1 | 9/2014 | Liao et al. | |

FOREIGN PATENT DOCUMENTS

| | | | |
|---|---|---|---|
| DE | 10129189 | A1 | 1/2003 |
| DE | 10340234 | A1 | 4/2005 |
| DE | 102007003161 | A1 | 7/2008 |

* cited by examiner

*Primary Examiner* — Curtis Odom
(74) *Attorney, Agent, or Firm* — Browdy and Neimark, PLLC

(57) ABSTRACT

A method for operating a remote control system includes the method steps of providing a remote control system with an operating unit having a display and at least one operating element and with a communication unit having a communication connection to the operating unit, providing a control unit, which has a communication connection to the communication unit, of a work machine, detecting an operating unit actual configuration with a plurality of operating and selection menus by using the operating unit, transmitting the operating unit actual configuration from the operating unit to the control unit, detecting a work machine actual configuration by using the control unit, selecting at least one of the operating and selection menus depending on the work machine actual configuration, transmitting the at least one operating and selection menu to the operating unit and displaying the at least one operating and selection menu on the display.

17 Claims, 1 Drawing Sheet

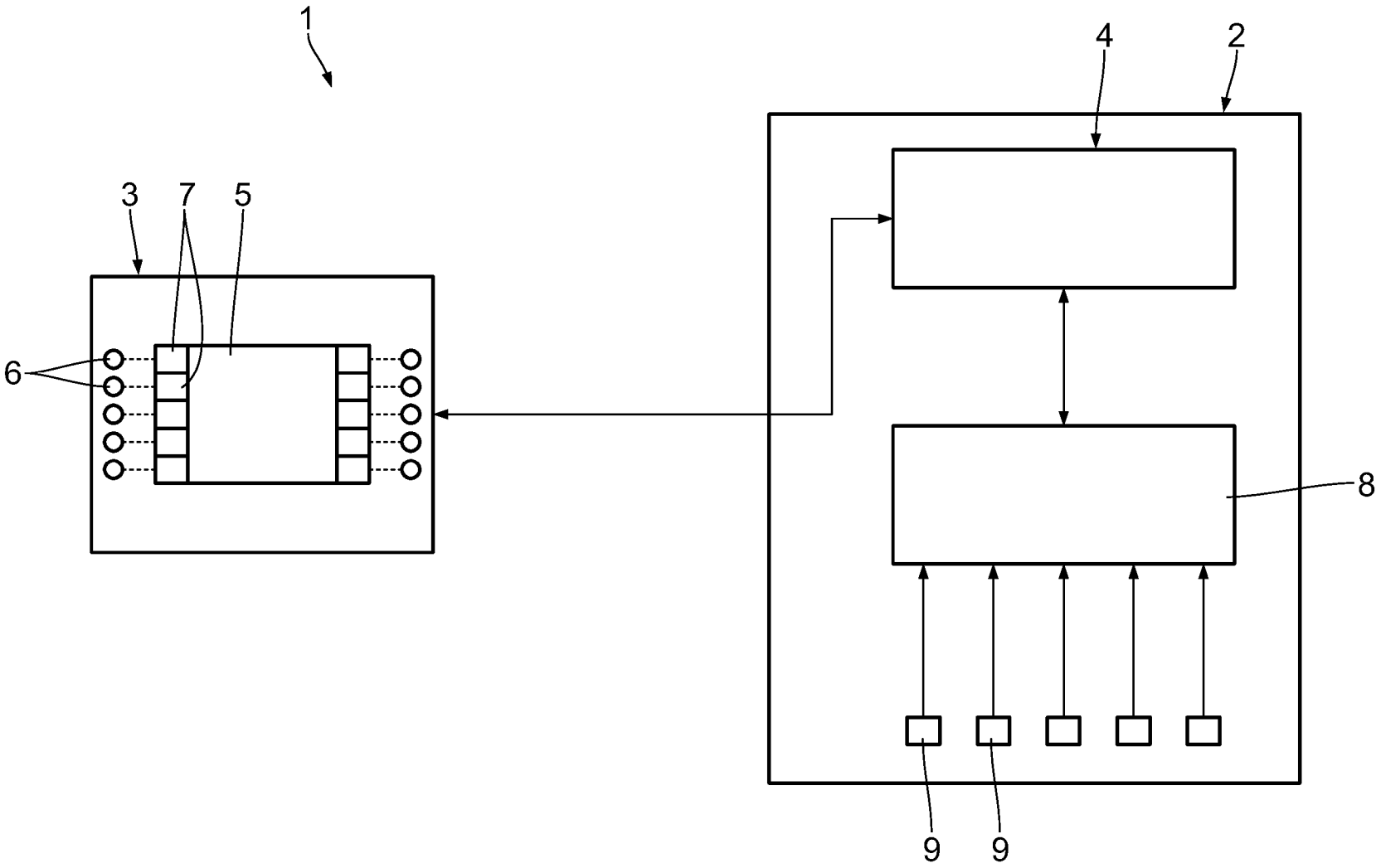
1
2
3
4
5
6
7
8
9
9

METHOD FOR OPERATING A REMOTE CONTROL SYSTEM AND REMOTE CONTROL SYSTEM OF THIS TYPE

CROSS-REFERENCE TO RELATED APPLICATIONS

This application claims the priority of German Patent Application, Serial No. DE 10 2012 216 489.87, filed on 17 Sep. 2012, pursuant to 35 U.S.C. 119(a)-(d), the content of which is incorporated herein by reference in its entirety as if fully set forth herein.

FIELD

The invention relates to a method for operating a remote control system and a remote control system of this type.

BACKGROUND

Work machines, which can be operated by means of a remote control system, have been known for a long time. A work machine comprises a large number of components and adjusting units, which can be actuated by means of the remote control system. Because of the complexity of the work machine, operating the remote control system by means of an operating unit is complicated. The operating unit, in particular in a complex work machine, requires a large number of displays and operating elements. An operating element may, for example, be a push button, a switch, a control lever or a rotary switch. To reduce the number of operating elements on the operating unit, a screen may be used in the operating unit. A screen allows by means of a plurality of operating menus, in particular with changing symbols and/or displays, a plurality of functions to be assigned to a reduced number of operating elements. As a result, an increased function density can be achieved. The increased function density leads, however, to an increased operating effort for an operator. In particular, it is disadvantageous that the operator has to navigate through an increased number of operating menus.

SUMMARY

An object of the present invention is therefore to improve a method for operating a remote control system in such a way that operation is simplified.

This object is achieved by a method for operating a remote control system comprising the method steps of providing a remote control system with an operating unit having a display and at least one operating element and with a communication unit having a communication connection to the operating unit, providing a control unit, which has a communication connection to the communication unit, of a work machine, detecting an operating unit actual configuration with a plurality of operating and selection menus by means of the operating unit, transmitting the operating unit actual configuration from the operating unit to the control unit, detecting a work machine actual configuration by means of the control unit, selecting at least one of the operating and selection menus depending on the work machine actual configuration, transmitting the at least one operating and selection menu to the operating unit, and displaying the at least one operating and selection menu by means of the display.

According to the invention, it was recognized that it is possible to reduce the number of operating and selection menus that are displayed to an operator by means of a display of an operating unit of a remote control system. A selection of at least one operating and selection menu depending on a work machine actual configuration is used for this purpose. Depending on the work machine actual configuration, the navigation possibility between the operating and selection menus is thus sensibly reduced in that a preselection of sensible menus is carried out. The preselection takes place, in particular, automatically. The work machine actual configuration is detected by means of a control unit of the work machine. The control unit has a communication connection to a communication unit. The communication unit is a component of the remote control system and is used for communication with the operating unit. The operating unit is connected, in particular, cablelessly to the communication unit. This may, for example, take place by radio. However, other cableless signal transmission possibilities such as Bluetooth are conceivable. The communication unit is, in particular, arranged directly in the work machine to be operated thereby. The communication unit is, for example, connected by cable to the control unit. The number of operating and selection menus displayed on the operating unit by means of the display is reduced by means of the selection. Apart from the functions of the work machine, the control unit, in particular, also controls the displaying of the operating and selection menus on the operating unit. An operating unit actual configuration has an operating unit actual menu structure, which is formed by the operating and selection menus. The operating unit actual menu structure of the operating unit can be changed in a targeted manner by selecting and transmitting the operating and selection menus to the operating unit. The changing of the operating unit actual menu structure is simplified by this. The method according to the invention thus not only allows an individualized key assignment of a remote control, but, in a targeted manner, allows an adaptation of a structure of various menus. Each menu, for example operating menus and/or selection menus, is suitable for handling the remote control system. The handling of the remote control system and the operation of the work machine are simplified. In particular, it is unnecessary for an operator himself to have to take on, in other words manually, a complex menu control on the operating unit. In particular, it is unnecessary for the operator to reduce the number of operating and selection menus and, in particular, to deselect unnecessary operating and selection menus. The operator is relieved of navigating through the relevant operating and display menus. In particular, the number of work steps that the operator has to carry out is reduced. A method of this type is effective and therefore economical. A method of this type is less prone to faults. In particular, a faulty navigation by the operator, in other words the selection of irrelevant operating and selection menus, is ruled out. The method allows a work machine to be operated with an increased reliability. The selection in particular takes place in the control unit of the work machine. In particular, by means of the selection, the number of operating and display menus that can be selected by an operator is reduced to a number of relevant operating and display menus. Irrelevant operating and display menus are not displayed. As a result, the clarity of the display of the operating unit is increased for the operator. Since exclusively the relevant operating and display menus are shown, these could be selected more quickly and directly. This can, for example, take place directly after switching on the remote control without the operator having to navigate through a series of irrelevant operating and display menus. The method allows the work machine to be handled with improved economy. The method according to the invention allows, in particular, one and the same remote control to be used in work machines of different types. In particular, it is unnecessary for the remote control to have to be programmed or parameterized depending on the type. The use of one and the same remote control in different work machines is thereby simplified. Additional work steps to adapt the remote control to different work machines are unnecessary.

A method in which the operating unit actual configuration comprises a content of the display and a state of at least one operating element allows a comprehensive detection of an actual configuration of the operating unit. Apart from a content of the display itself, a state of the at least one operating element is also detected. An operating element may, for example, be a push button, a switch, a control lever or a rotary switch. The respective state indicates in what position the respective push button, switch, control lever or rotary switch is located.

A method in which the selection takes place automatically is convenient. In particular, it is unnecessary for the operator to react to any changes in the work machine. The selection takes place at least in a partly automated manner and, in particular, fully automatically.

A method in which the selection takes place by means of the control unit allows the method to be carried out effectively. Since the operating unit actual configuration is transmitted to the control unit and the work machine actual configuration is simultaneously detected in the control unit, the selection can take place there directly. Further signal transmissions are unnecessary.

A method in which the selection is a reduction from available operating and selection menus, in particular it takes place by means of predefined selection criteria, leads to a direct and automatic simplification of the display.

A method in which only one operating and selection menu is made available by the selection allows a targeted operation of the remote control system.

A method which is characterized by a flexible, in particular work machine-independent, use of the remote control system can be used universally.

A method in which the work machine actual configuration comprises an operating state of the work machine allows an optimized operation of the remote control system adapted to the situation.

A method in which the operating state of the work machine comprises at least one of the criteria type of work machine, setup state of the work machine, operating type of the work machine, detected machine data, and type of activation of the remote control system is used to take into account important criteria of the work machine. An optimized operating and display menu directed thereto allows simplified and direct handling for the operator.

A method which is characterized by a repeated, in particular at regular time intervals, or continuous detection of the work machine actual configuration and automatic adaptation of the at least one operating and selection menu to be displayed allows an operator an updated display of the operating and display menu that is adapted to the situation. In particular changing states with respect to time, for example of the work machine, are directly detected and taken into account when selecting the operating and display menus.

A further object of the invention is to provide a remote control system for the remote-controlled operation of a work machine, the operation of which is simplified.

This object is achieved by a remote control system for the remote-controlled operation of a work machine comprising an operating unit with a display and at least one operating element, a communication unit, which has a communication connection to the operating unit and has an interface for connection to a control unit of the work machine, wherein the interface is a standard interface.

According to the invention, it was recognized that a remote control system has an operating unit and a communication unit having a communication connection thereto. The communication unit is used for connection to the control unit of the work machine. For this purpose, the communication unit has an interface, which is configured as a standard interface. As a result, it is, in particular, possible to connect the remote control system via the communication unit to control units of different work machines. A control system of this type is flexible and can be used universally. In particular it is conceivable for one and the same remote control system to be used for the remote-controlled operation of various work machines. Since the interface is a standard interface, the connection to the respective control unit is possible in a rapid and uncomplicated manner. The standard interface is robust and requires an uncomplicated and reliable connection of the operating unit to the control unit. A data bus, in particular a Controller Area Network (CAN) bus or an Ethernet interface can be used, for example, as the standard interface.

A remote control system in which the at least one operating element is integrated in the display of the operating unit and the display is, in particular, configured as a touch screen has an operating element with increased clarity. Since the operating element is integrated in the display of the operating unit, the operating element can be displayed graphically as a symbol on the display and as a button, in particular by means of a touch screen.

A remote control system in which the communication unit is integrated in the control unit allows an improved integration into the work machine. The communication unit can be integrated as a separate module into the control unit.

An embodiment of the invention will be described in more detail below with the aid of the drawing.

BRIEF DESCRIPTION OF THE DRAWING

FIG. 1 shows a schematic view of a remote control system.

DETAILED DESCRIPTION

A remote control system 1 shown schematically in FIG. 1 is used for the remote-controlled operation of a schematically shown work machine 2. The work machine 2 may, for example, be a digger or a crane.

The remote control system 1 comprises an operating unit 3 and a communication unit 4, which has a communication connection to the operating unit 3. The communication connection is cableless, for example by means of a radio connection. The communication connection is bidirectional and allows a communication from the operating unit 3 to the communication unit 4 and vice versa. The communication unit 4 is arranged in the work machine 2 and, in particular, integrated in the work machine 2. It is also possible for the communication unit 4 to be arranged externally on the work machine 2.

The operating unit 3 comprises a display 5 in the form of a screen or a display. Furthermore, the operating unit 3 comprises a plurality of, according to the embodiment shown, ten, operating elements 6 in the form of switches. The operating elements 6 are used to operate the operating unit and, in particular, to trigger an action. The operating elements 6 correspond with symbolic buttons 7 on the display 5. The buttons 7 indicate the respective configuration of the operating elements 6, in particular the respective position of a switch. It is also possible for the display 5 to be configured as a touch screen. In this case, the operating elements 6 may be integrated in the touch screen so the operating elements 6 can be operated by touching the touch screen. The risk of an unintentional actuation of an operating element 6 is thereby reduced.

The communication unit 4 has a communication connection to a control unit 8 of the work machine 2. The communication connection is, in particular, connected by cable and, for example, implemented by a data bus. The communication connection is bidirectional. The communication connection allows a data transmission from the communication unit 4 to the control unit 8 and vice versa.

The control unit 8 has a signal connection to various components 9 of the work machine 2. According to the embodiment shown, five components 9 are provided. More or less than five components 9 may also have a signal connection to the control unit 8. Sensors of the work machine 2, such as, for example, temperature, pressure, speed or other sensors, may, for example, serve as components 9. The components 9 may also be configured as manual switches. The respective current states of the components 9 are transmitted to the control unit 8 by the signal connection of the components 9 to the control unit 8. It is also possible to allow a signal connection from the control unit 8 to at least one of the components 9 in order to detect the respective, current state of the components 9 directly by the control unit 8. It is possible, as a result, for the respective current state of the component 9 to be detected directly and automatically by the control unit 8. In particular, it is unnecessary for the component 9 to automatically transmit the current state to the control unit 8. The control unit 8 can determine an operating state of the work machine 2 from the sum of the individual states of the respective components 9.

A method for operating the remote control system 1 will be described in more detail below. The remote control system 1 with the operating unit 3 and the communication unit 4 is firstly provided. Furthermore, the control unit 8, which has a communication connection to the communication unit 4, is provided. An operating unit actual configuration is then detected by means of the operating unit 3. The operating unit actual configuration comprises, in particular, a plurality of operating and selection menus to display the respective configurations and states of the operating elements 6 such as, for example, switching states of push buttons or other switching elements. Furthermore, the operating unit actual configuration comprises graphics shown by means of the display 5. The operating unit actual configuration is transmitted from the operating unit 3 via the communication unit 4 to the control unit 8. The control unit 8 then detects a work machine actual configuration. This takes place, in particular, in that the operating state of the work machine 2 is detected. The operating state of the work machine takes into account, in particular, the criteria such as the type of work machine, in other words digger, crawler crane, mobile crane or other work machine, setup state of the work machine, operating type of the work machine such as, for example, travelling mode, lifting/lowering mode, rotary mode or other modes, detected machine data and/or type of activation of the remote control system 1. Based on the work machine actual configuration and the operating unit actual configuration, at least one of the operating and selection menus is selected depending on the work machine actual configuration. This means that, depending on the requirements on graphics to show the work machine, the relevant operating and selection menus are determined and selected from the number of available operating and selection menus. The operating and selection menus selected as relevant are transmitted from the control unit 8 via the communication unit 4 to the operating unit 3 and shown there by means of the display 5.

As a result it is possible, proceeding from a number n of operating and selection menus, which can be shown by means of the operating unit 3, for there to be a reduction, depending on an operating state of the work machine 2, to a few operating and selection menus for each operating state. In particular, it is possible for precisely one, at most two or a few, such as, for example, three to five, operating and selection menus to be shown per operating state. If precisely two operating and selection menus are to be displayed at the operating unit 3 by means of the display 5, this may, for example take place by means of a button, which means that a scrolling can take place between the two mentioned relevant operating and display menus. The selection of the relevant operating and display menus takes place, in particular, automatically by means of the control unit 8, which is, in particular, an electronic control unit. An automatic control of the display-guided operating function of the remote control system 1 is thereby possible. The ergonomics are thus improved for an operator of the remote control system 1.

The remote control system 1, in particular the operating unit 3 and the communication unit 4, allow a flexible and work machine-independent use. In particular it is unnecessary for the hardware to have to be reconfigured or software reprogrammed. Advantageously, the communication unit 4 comprises a standard interface for connection to the control unit 8. This standard interface may be a standard cable connection. It is also possible for the communication unit 4 to be integrated in the control unit 8. In this case, the communication unit 4 may be arranged on a standard slot of a circuit board of the control unit 8. In particular, it is unnecessary for the operating unit 3 and/or the communication unit 4 to take on evaluation functions typical of the machine. A type-dependent programming or configuration takes place by means of the control unit 8 that is present in any case on the work machine 2. The remote control system 1 is used for the visualization and operation of the work machine. The storage and, in particular, the number of parts and replacement parts are reduced by the use of a remote control system of this type.

The invention claimed is:

1. A method for operating a remote control system comprising the method steps providing a remote control system with an operating unit having a display and at least one operating element and with a communication unit having a communication connection to the operating unit, providing a control unit, which has a communication connection to the communication unit, of a work machine, detecting an operating unit actual configuration with a plurality of operating and selection menus by using the operating unit, transmitting the operating unit actual configuration from the operating unit to the control unit, detecting a work machine actual configuration by using the control unit, selecting at least one of the operating and selection menus depending on the work machine actual configuration, transmitting the at least one operating and selection menu to the operating unit, and displaying the at least one operating and selection menu on the display.

2. A method according to claim 1, wherein the operating unit actual configuration comprises a content of the display and a state of at least one operating element.

3. A method according to claim 1, wherein the selection takes place automatically.

4. A method according to claim 1, wherein the selection takes place by using the control unit.

5. A method according to claim 1, wherein the selection is a reduction from available operating and selection menus.

6. A method according to claim 5, wherein the selection takes place using predefined selection criteria.

7. A method according to claim 1, wherein only one operating and selection menu is made available by the selection.

8. A method according to claim 1, comprising a flexible use of the remote control system.

9. A method according to claim 8, wherein the use of the remote control system is work machine independent.

10. A method according to claim 1, wherein the work machine actual configuration comprises an operating state of the work machine.

11. A method according to claim 10, wherein the operating state of the work machine comprises at least one of the following criteria:

type of work machine,
setup state of the work machine,
operating type of the work machine,
detected machine data, or
type of activation of the remote control system.

12. A method according to claim 1, comprising one of a repeated and a continuous detection of the work machine actual configuration and automatic adaptation of the at least one operating and selection menu to be displayed.

13. A method according to claim 12, wherein the repeated detection of the work machine actual configuration takes place at regular time intervals.

14. A remote control system for the remote-controlled operation of a work machine comprising:

a. an operating unit with a display and at least one operating element, and b. a communication unit, which has a communication connection to the operating unit and has an interface for connection to a control unit of the work machine, wherein the interface is a standard interface, wherein said control unit of the work machine is configured and operable to perform the method steps:

detecting an operating unit actual configuration with a plurality of operating and selection menus by using the operating unit, transmitting the operating unit actual configuration from the operating unit to the control unit, detecting a work machine actual configuration by using the control unit, selecting at least one of the operating and selection menus depending on the work machine actual configuration, transmitting the at least one operating and selection menu to the operating unit, and displaying the at least one operating and selection menu on the display.

15. A remote control system according to claim 14, wherein the at least one operating element is integrated in the display of the operating unit.

16. A remote control system according to claim 15, wherein the display is configured as a touch screen.

17. A remote control system according to claim 14, wherein the communication unit is integrated in the control unit.

* * * * *